US006109597A

United States Patent [19]

Sicking et al.

[11] Patent Number: 6,109,597

[45] Date of Patent: Aug. 29, 2000

[54] ANCHOR CABLE RELEASE MECHANISM FOR A GUARDRAIL SYSTEM

[75] Inventors: Dean L. Sicking; John D. Reid; John R. Rohde, all of Lincoln, Nebr.

[73] Assignee: Safety By Design, Inc., Lincoln, Nebr.

[21] Appl. No.: 09/063,910

[22] Filed: Apr. 21, 1998

Related U.S. Application Data

[62] Division of application No. 08/832,422, Apr. 2, 1997, Pat. No. 5,775,675.

[51] Int. Cl.[7] ..... E01F 15/00

[52] U.S. Cl. ..... 256/13.1; 256/1; 248/548; 248/900; 404/6

[58] Field of Search ..... 256/1, 13.1; 404/6, 404/7, 8, 9; 411/383, 546, 535, 536; 248/548, 549, 900

[56] References Cited

U.S. PATENT DOCUMENTS

| | | | |
|---|---|---|---|
| 5,018,920 | 5/1991 | Speakman | 411/383 X |
| 5,078,366 | 1/1992 | Sicking et al. | 256/13.1 |
| 5,391,016 | 2/1995 | Ivey et al. | 256/13.1 X |
| 5,490,661 | 2/1996 | Stevens et al. | 256/13.1 |
| 5,765,811 | 6/1998 | Alberson et al. | 256/13.1 |
| 5,775,675 | 7/1998 | Sicking et al. | 256/13.1 |

FOREIGN PATENT DOCUMENTS

| | | | |
|---|---|---|---|
| WO 94/29528 | 12/1994 | WIPO | 256/13.1 |

*Primary Examiner*—Lynne H. Browne
*Assistant Examiner*—John Cottingham
*Attorney, Agent, or Firm*—Jackson Walker L.L.P.

[57] ABSTRACT

A highway guardrail terminal system having horizontally extending guardrail elements mounted on a plurality of posts. An anchor cable release bracket attached to a rail element by sleeved mounting bolts has an arrangement of slots and openings to quickly release an anchor cable system from the guardrail.

2 Claims, 5 Drawing Sheets

ANCHOR CABLE RELEASE MECHANISM FOR A GUARDRAIL SYSTEM

This application is a divisional application of U.S. patent Ser. No. 08/832,422 filed Apr. 2, 1997, now U.S. Pat. No. 5,775,675 patented on Jul. 7, 1998 and incorporated herein by reference for all purposes.

BACKGROUND OF THE INVENTION

The present invention relates to an improved anchor cable release mechanism for a guardrail system.

Existing highway guardrail end treatment systems include: the breakaway cable terminal (BCT), the eccentric loader terminal (ELT), the modified eccentric loader terminal (MELT), the vehicle attenuating terminal (VAT), the extruder terminal (ET), and the slotted rail terminal (SRT).

In all of these systems, a cable anchor assembly is used to transmit tensile forces from the rail element to the anchor or foundation in impacts with the sides of the guardrails. For end-on impacts into the terminal, the cable anchor assembly must be able to release from the anchor or the rail element. Otherwise, the cable anchor assembly will impede the forward movement of the impacting vehicle, resulting in excessive deceleration and damage to the vehicle. The prior art systems release the cable anchor assembly through breaking of the end post or disengagement of the cable attachment from the rail element. The present invention provides a unique improved anchor cable release mechanism that facilitates quick release of the cable anchor attachment from the rail element.

SUMMARY OF THE PRESENT INVENTION

The present invention cooperates within a highway guardrail or crash attenuation system which comprises a horizontally extending guardrail mounted on a plurality of vertically extending rail posts. The guardrail is mounted, along a vertical axis, to the posts. An impact head terminal member is slidingly positioned at a first end over the guardrail. The back end of the impact head is provided with an engaging plate which is designed to generally receive the engagement of an impacting vehicle. At the front end of the impact head, an inlet is provided to receive the leading end of the guardrail. A guide tube is attached to the inlet to guide the guardrail into the inlet. Further, attached at the inlet is a kinker beam which cooperates with a kinking deflector plate rigidly attached within and extending transversely across the head to generate kinks, or plastic hinges, in the rail element at discrete locations along the guardrail. The deflector plate is provided with a multiplicity of discrete, intersecting, angular faces upon which the rail element impacts as the impact head is horizontally displaced along the guardrail upon engagement of an impacting vehicle.

An anchor cable release bracket of the present invention has tapered slots along a first side and enlarged openings along an opposite side. The bracket is attached to the rail element by sleeved mounting bolts. The bracket is shifted laterally and one side is forced away from the rail element and off of the mounting bolts upon impact of the guide tube.

BRIEF DESCRIPTION OF THE DRAWINGS

The invention will be better understood and objects other than those set forth above will become apparent when consideration is given to the following detailed description of the preferred embodiments. Such description makes reference to the annexed drawings wherein.

DETAILED DESCRIPTION OF THE PREFERRED EMBODIMENT

Figure 1:
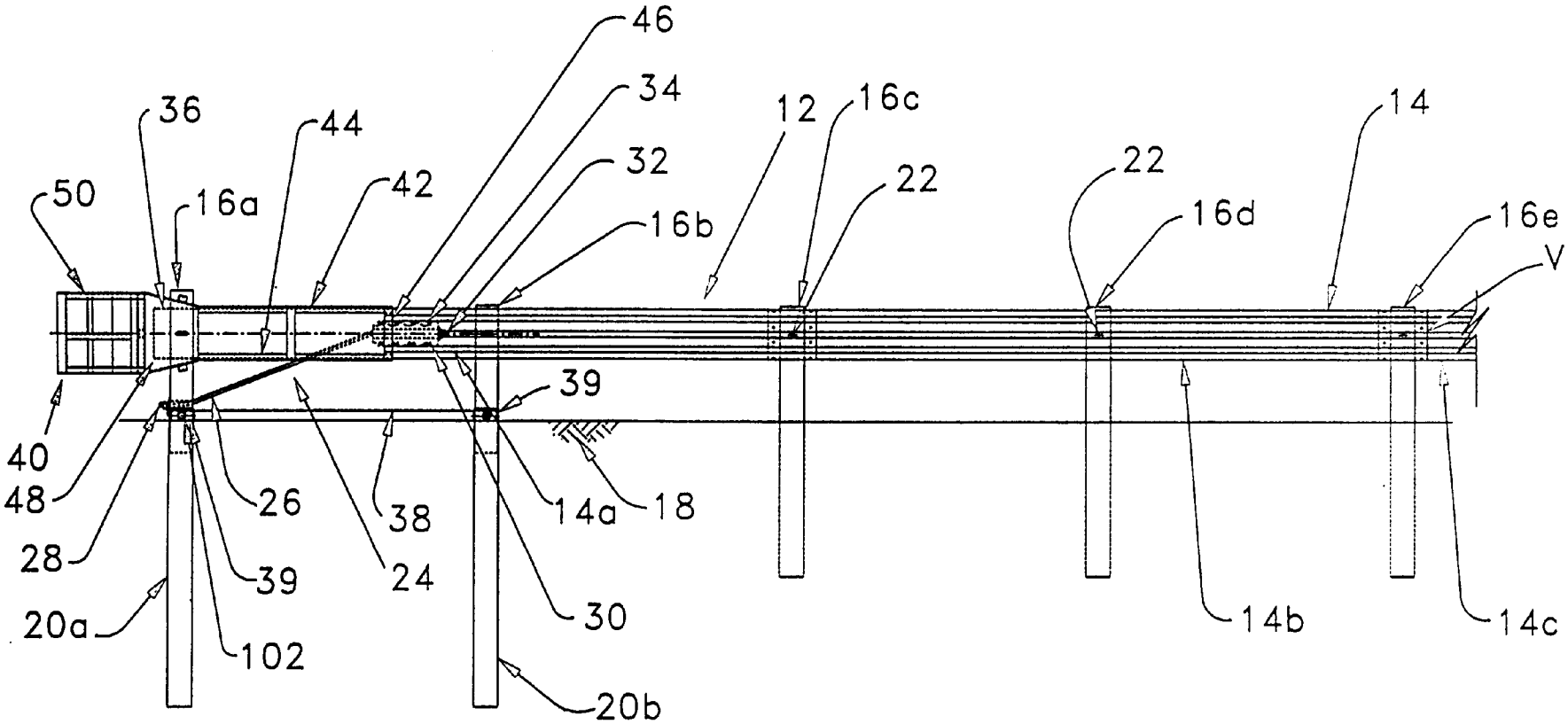
FIG. 1 illustrates a side elevation view of a first embodiment of the present inventive highway guardrail terminal system.

Referring now to the drawings, and more particularly to FIG. 1, the reference numeral (12) generally represents an energy dissipating guardrail terminal using the sequential kinking concept. The terminal which is adapted to be connected to the upstream side of a conventional guardrail (14) consisting of standard W-beam guardrail sections, either approximately 12'6" or 25' in length. The guardrail sections or rail elements **(14*a*–14*c*) are attached along their vertical axes (V) by bolts (22) to a plurality of vertical breakaway posts (16*a*–16*e*) spaced apart approximately 6'3" from each other. It should be understood that the sequential kinking terminal is effective with other spacing distances. Any suitable number of posts may be used depending upon the expanse of the guardrail run. FIG. 1 illustrates five wooden breakaway posts. Wooden posts (16*c*–16*e*) are shown embedded directly into the soil (18). Lead post (16*a*) and second post (16*b*), which are shorter in length than the other posts, are shown inserted within unique foundation sleeves (20*a* and 20*b*)** which will be further described below.

Figure 5:
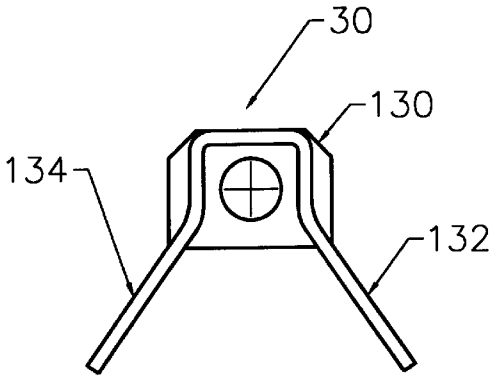
FIG. 5 illustrates an end view of a cable release bracket of the present invention.
Figure 6:
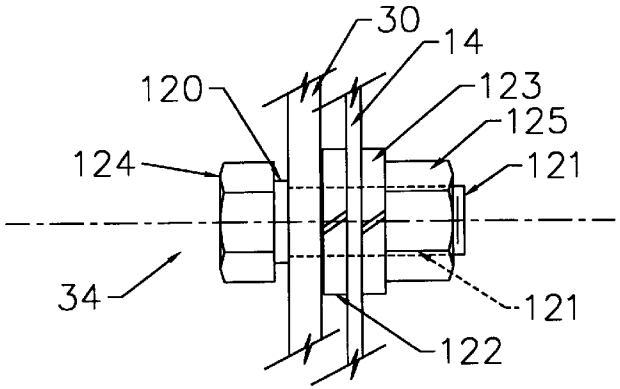
FIG. 6 illustrates a side elevation view of the quick release sleeved mounting bolt of the present invention.
Figure 4:
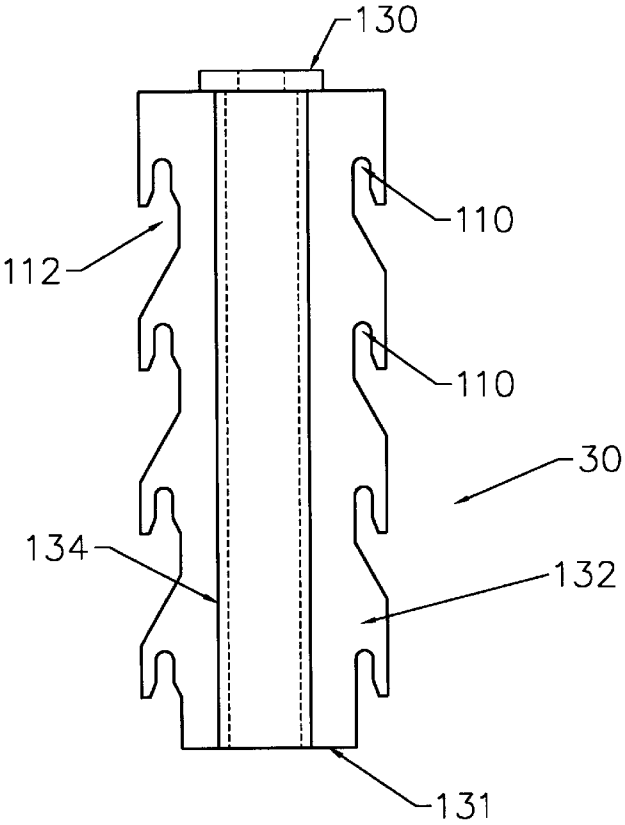
FIG. 4 illustrates a cable release bracket of the present invention.

FIG. 1 further illustrates the anchor cable mechanism (24) of the present invention which includes an anchor cable (26), lower anchor cable bolt (28), a unique and novel anchor cable release bracket (30), an upper anchor cable bolt (32), and eight unique and novel sleeved bolts (34). The anchor cable mechanism is provided to allow the terminal (12) to withstand angular vehicle impacts downstream of its upstream end (36). FIGS. 4 and 5 show the detail construction of the quick release bracket which is held in tension on rail element **(14*a*) by the sleeved bolts (34) (FIG. 6). In addition, a ground strut (38) having a U-shaped yoke (39) on each end extends between the first and second posts and is provided for additional support for the anchor cable forces. A bolt or fastener (102)** extends through the yoke and the post to secure the strut in place.

It is intended that a vehicle will impact the guardrail (14) downstream of its upstream end (36); however, a collision with the end (36) requires the provision of an end treatment designated by reference numeral (40) to reduce the extent of injury to the impacting vehicle and its occupants. The purpose of the end treatment (40) is to dissipate impact energy of the vehicle.

Figure 2:
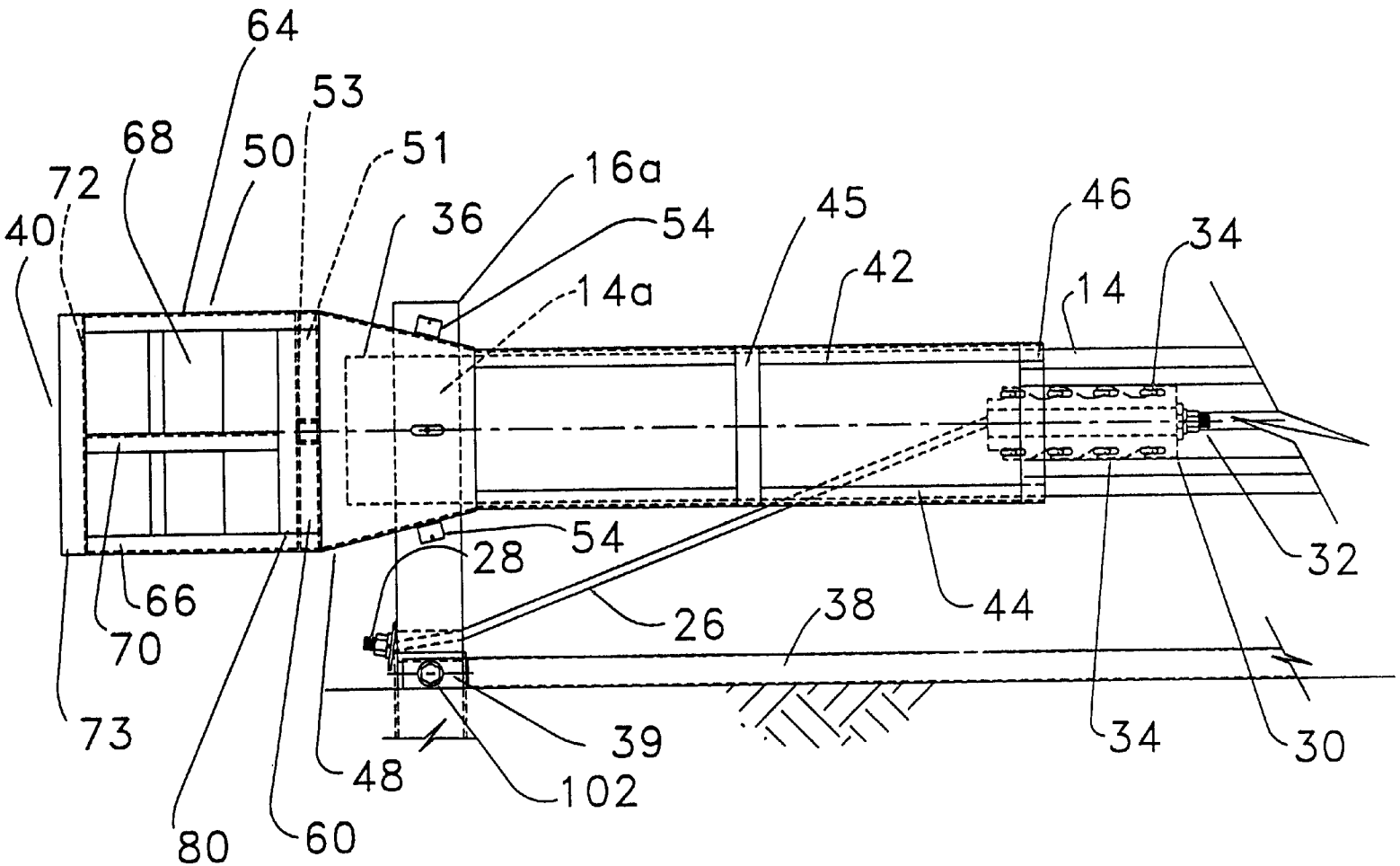
FIG. 2 illustrates a side elevation view of the impact head, guide tube, and cable release mechanism of the present invention.

FIG. 2 illustrates a side view of the end treatment (40). The end treatment (40) includes top guide rail (42), bottom guide rail (44), center guide rail strap (45), end guide rail straps (46), guide tube (48), impact head (50) and kinker beam (51). The impact head (50) is attached on the upstream end of guide tube (48). Guide tube (48) is mounted onto lead post (16*a*) by fasteners (52) passing through post angle brackets (54). The upstream end (36) of the rail element (14*a*) extends into the guide tube (48).

It may be seen that the top (42) and bottom (44) guide rails extend downstream along and above the upper and lower edges of the guardrail (14), respectively. Guide straps (45 and 46) maintain the top and bottom guide rails in spaced apart relation. The guide rails ensure that the W-beam rail (14) is guided properly into the guide tube (48) and impact head (50) without the impact head (50) or guide tube (48) rotating or twisting as the end treatment (40) moves down the length of the W-beam rail (14) during a collision.

Figure 3:
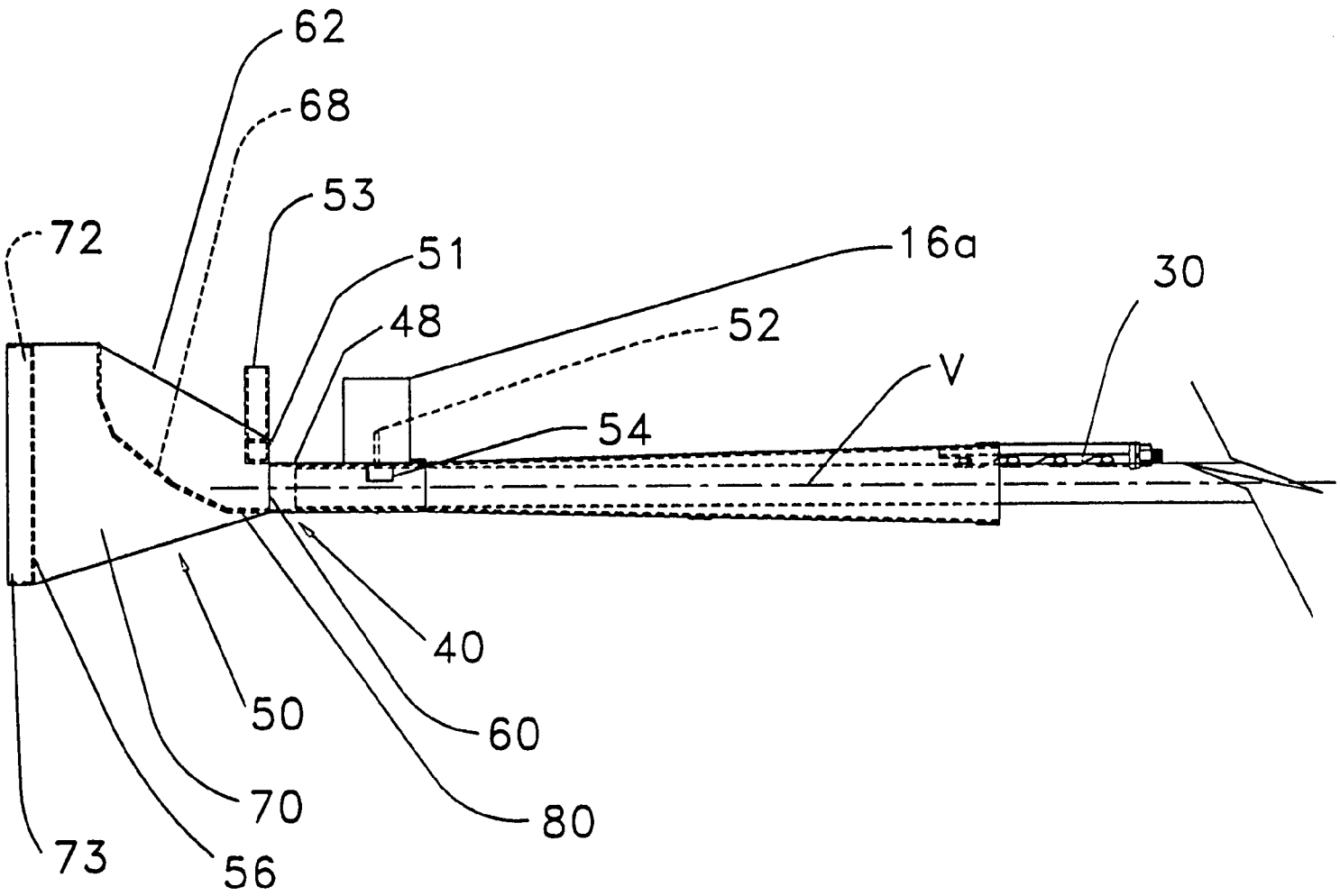
FIG. 3 illustrates a top view of the impact head, guide tube, and cable release mechanism of the present invention.

Impact head (50) has an inlet (60) and an outlet (62) (FIG. 3). A top plate (64), and a bottom plate (66), house a sequential deflector plate (68), a support gusset (70), and a front impact plate (72). At the inlet (60), the kinker beam (51) is attached to the top plate (64) and the bottom plate (66) and spaced apart from the first deflector face (80) of deflector plate (68). The kinker beam (51) is a 20"×2"×2" steel box tube but any comparable sizing may be used.

It is through this inlet (60) (which is about 4" wide) between the first deflector face (80) and the kinker beam (51) that the W-beam rail element (which is about 3" wide) passes when the impact head (50) is displaced downstream along rail (14) during collision.

Extending generally perpendicular from the side of kinker beam (51) is a 6"×2"×2" box tube, post breaker (53). The post breaker beam (53) is welded to the kinker beam (51) and extends outwardly approximately 6" from the side of the kinker beam. Other suitable dimensions may be used. However, the length of the post breaker beam (53) is sufficient to extend the full width of the wood post (16*a*). The post breaker beam (53) is also generally perpendicular to the vertical axis (V) of the W-beam and is designed to engage and break the lead post (16*a*) when the impact head (50) is displaced downstream in a collision.

Post (16*a*) is provided with a 2½" diameter hole through which passes a portion of the anchor cable (26). The hole is positioned slightly above the yoke (39) of strut (38). When the impact head is displaced downstream in a collision, the post breaker beam engages the full width of post (16*a*) and post (16*a*) will snap or break at the hole in the post. By having the beam (53) extend the full width of the post (16*a*), the tests have shown that the post (16*a*) more easily and cleanly breaks just above the yoke (39) at the anchor cable hole.

FIG. 3 illustrates a top view of the sequential kinking deflector plate (68) which is welded inside of impact head (50) to the inside surface of top plate (64) and bottom plate (66). Deflector plate (68) is approximately ¼" thick and 20" in height. 20" is the distance top plate (64) is spaced apart from parallel bottom plate (66). The deflector plate (68) extends from the inlet (60) to the outlet (62) of the impact head (50).

The sequential kinking concept entails dissipation of the kinetic energy of the impacting vehicle through kinking of the rail element (14). When the end treatment (40) is impacted end-on by an errant vehicle, the impact plate (72) will engage and interlock mechanically with the front of the vehicle. As the vehicle proceeds forward, the impact head (50) will be moved forward or downstream along the rail element (14). The post breaker beam (53) on the side of the kinker beam (51) will contact and break off the first or lead breakaway wooden post (16*a*), thus releasing the tension on the cable (26) of the cable anchorage system (24).

At or shortly after breaking of the lead post (16*a*), the end (36) of the rail element (14*a*) will contact the deflector plate (68) within the impact head and kink the rail element (14(*a*).

The kinked section will eventually exit the impact head (50) through outlet (62) on the backside of the impact head (50) away from the traffic.

This kinking process will continue as the vehicle proceeds forward and pushes the impact head (50) along. As the downstream portion of the guide tube reaches cable release bracket (30) on the rail element (14*a*), the cable release bracket, which is held on rail (14) by the unique and novel sleeved bolts (34), will be pushed forward, slide off the bolts (34), and be released from the rail element (14*a*).

For impacts that are either end-on at a large angle or near the end of the end treatment (40) (e.g., between posts 16*a* and 16*b*), the impacting vehicle will break off the first couple of posts, bend the rail element, and gate behind the end treatment (40) and guardrail installation.

For impacts into the side of the terminal downstream of the beginning of length-of-need which is selected to be at the third post (16*c*) or 12'6" downstream from the terminal end (36), the terminal (12) will act like a standard guardrail section and will contain and redirect the impacting vehicle. The cable attachment system (24) and ground strut (38) will provide the necessary anchorage to resist the tensile forces acting on the rail element to contain and redirect the vehicle.

The unique cable release mechanism (24) serves the dual functions of: (1) transmitting the tensile force from the rail element (14*a*) to the lead post (16*a*) and the foundation sleeve (20*a* or 20*b*) via the cable anchor assembly (24) for impacts with the side of the guardrail; i.e., redirectional impacts; and (2) releasing the cable bracket (30) from the rail element (14) so that the rail element may properly feed through the impact head (50).

The cable release mechanism of the present invention incorporates a novel and unique cable release bracket (30) with sleeved bolts (34). FIGS. 4 and 5 show that cable release bracket (30) is fabricated in a manner similar to the standard cable anchor bracket by cutting angled slots (110) into the bracket. In head-on impacts, the leading edge of the guide tube will impact the upstream end (131) of the bracket (30) and push the bracket forward, thus releasing the bracket (30) from sleeve (120) of the mounting bolts (38) (see FIG. 6) attached to the rail element (14). As may be seen in FIG. 6, the rotatable sleeve (120) provides a fixed space between washer (122) and bolt head (124).

The cable release bracket 30 has tapered or wedged slots (110) on one side and enlarged tapered openings (112) which fit behind the mounting bolts on the opposite side.

In FIG. 5 it may be seen that the sides (132 and 134) of bracket (30) lie in two different planes. Having the tapered slot (110) on one side and the enlarged tapered slots (112) on the other side allows the bracket to be affixed to a W-beam in two rows in two different slip planes and still be lifted off the rail element when the bracket (30) is pushed forward in a collision. Without the opposed enlarged tapered slots (112), the bracket would not freely release from the rail element.

To further improve the release of the anchor cable system (24) the bracket (30) is attached to the rail element by specially designed sleeved bolts (34). FIG. 6 illustrates that bolt (34) is provided with a head (124) and a rotatable sleeve (120) which slides over the bolt shank (121). A washer or spacer (122) is welded or otherwise rigidly affixed to the shank so as to provide a fixed gap or space between the head (124) and the spacer (122). The anchor cable bracket (30) slides over the rotatable sleeve (120) with the bolt (34) fitting into the appropriate slots (110 and 112). The bolts (34) are affixed to the rail element (14) by passing the shank (121) through a hole or slot in the element and tightening washer (123) against the back side of the element with nut (125). Because the fixed space between head (124) and space (122) is greater than the thickness of the bracket, and because the bracket may easily slide over the rotatable sleeve (120), the bracket (30) is quickly and easily released upon a head-on impact. However, the bracket is not released upon a side impact.

Figure 7:
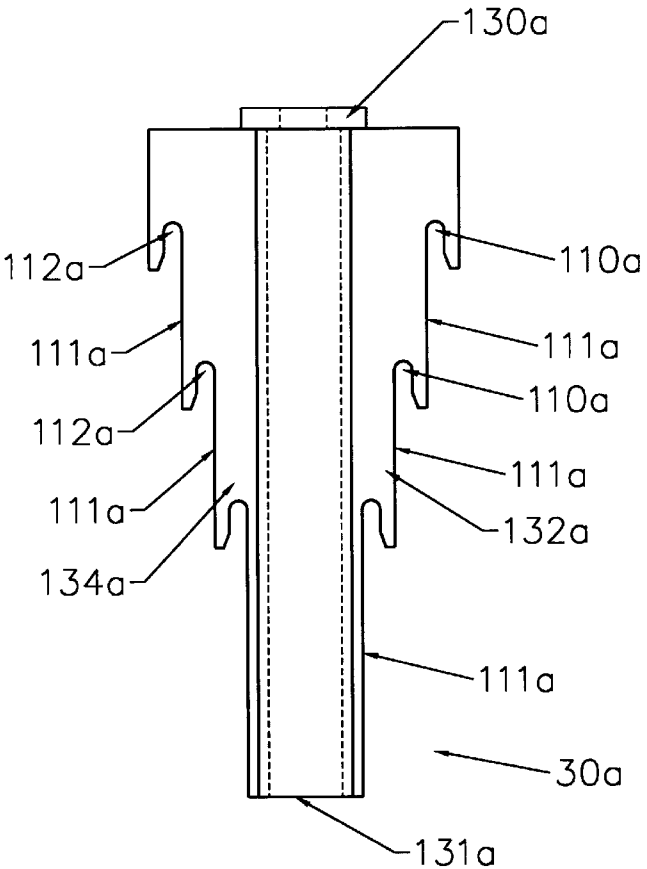
FIG. 7 illustrates an alternative embodiment of a cable release bracket of the present invention.

An alternative embodiment of an anchor cable bracket (30*a*) of the present invention is shown in FIG. 7. In bracket (30*a*) the two side walls (132*a* and 134*a*), which lie in different planes, are provided with slots (110*a* and 112*a*); however, the size of the slot opening is the same. An extended, straight slip ceiling (111*a*) is associated with each slot. When the bracket (30*a*) is pushed forward upon a head-on impact, rotatable sleeve (120) of the sleeve bolts (34) slides along slip ceiling (111*a*) until the bolt head (124) is out of the slot (110*a* or 112*a*), and the bracket may fall from the rail element.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

It is claimed:

1. An anchor cable release mechanism in combination with a guardrail system, said guardrail system having a rail element and an anchor cable comprising:

a first set and a second set of cable release bracket bolts connected to a first section of said rail element of said guardrail system, said first set and said second set of bolts aligned in separate rows along said rail element, said bolts having a sleeved section;

a cable release bracket releasably attachable to said cable release bracket bolts, said bracket having a first side with a plurality of tapered slots slidingly engageable on said sleeved section of said first set of said bolts, said bracket having a second side with enlarged openings slidingly engageable on said second set of said bolts, said bracket adapted to lift off said second set of said bolts as said first side of said bracket slides upon said sleeved section of said first set of said bolts as tension is released on said cable of said guardrail system.

2. The mechanism of claim 1 wherein said mounting bolt farther comprises:

a shank having a first end extendable through an opening in said rail element;

a head rigidly attached to a second end of said shank;

a fixed spacer rigidly attached to a mid portion of said shank and spaced apart from said head; and the sleeved section comprising;

a sleeve rotatably positioned over said shank between said head and said spacer.

* * * * *